US007273105B2

(12) United States Patent
Johansen et al.

(10) Patent No.: US 7,273,105 B2
(45) Date of Patent: Sep. 25, 2007

(54) MONITORING OF A RESERVOIR

(75) Inventors: John A. Johansen, Kongsberg (NO); Morten Sivertsen, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 297 days.

(21) Appl. No.: 10/499,442

(22) PCT Filed: Dec. 18, 2002

(86) PCT No.: PCT/NO02/00488

§ 371 (c)(1),
(2), (4) Date: Nov. 22, 2004

(87) PCT Pub. No.: WO03/058282

PCT Pub. Date: Jul. 17, 2003

(65) Prior Publication Data

US 2005/0061513 A1 Mar. 24, 2005

(30) Foreign Application Priority Data

Dec. 19, 2001 (NO) ..... 20016215

(51) Int. Cl.
*E21B 29/12* (2006.01)

(52) U.S. Cl. ..... 166/336; 166/360

(58) Field of Classification Search ..... 166/336, 166/360, 366, 250.01
See application file for complete search history.

(56) References Cited

U.S. PATENT DOCUMENTS

| | | | | |
|---|---|---|---|---|
| 4,016,942 | A | 4/1977 | Wallis, Jr. et al. | |
| 4,138,669 | A * | 2/1979 | Edison et al. | 340/3.51 |
| 5,131,477 | A | 7/1992 | Stagg et al. | |
| 6,006,832 | A | 12/1999 | Tubel et al. | |
| 6,131,658 | A | 10/2000 | Minear | |
| 6,644,410 | B1 * | 11/2003 | Lindsey-Curran et al. | 166/360 |

FOREIGN PATENT DOCUMENTS

| | | | |
|---|---|---|---|
| GB | 2 262 340 | A | 6/1993 |
| WO | WO99/63202 | A1 | 12/1999 |
| WO | WO 01/23705 | A1 | 4/2001 |

* cited by examiner

*Primary Examiner*—William Neuder
(74) *Attorney, Agent, or Firm*—Henry C. Query, Jr.

(57) ABSTRACT

A system is described for monitoring a subsea formation, which is under development. Instruments located in a completed but unconnected well are employed for providing information by a provisional monitoring unit being lowered downhole and connected to the well. Changes in the reservoir as a result of operations in other adjacent wells are intercepted by the instruments in the well and transmitted via an acoustic link to the surface.

13 Claims, 1 Drawing Sheet

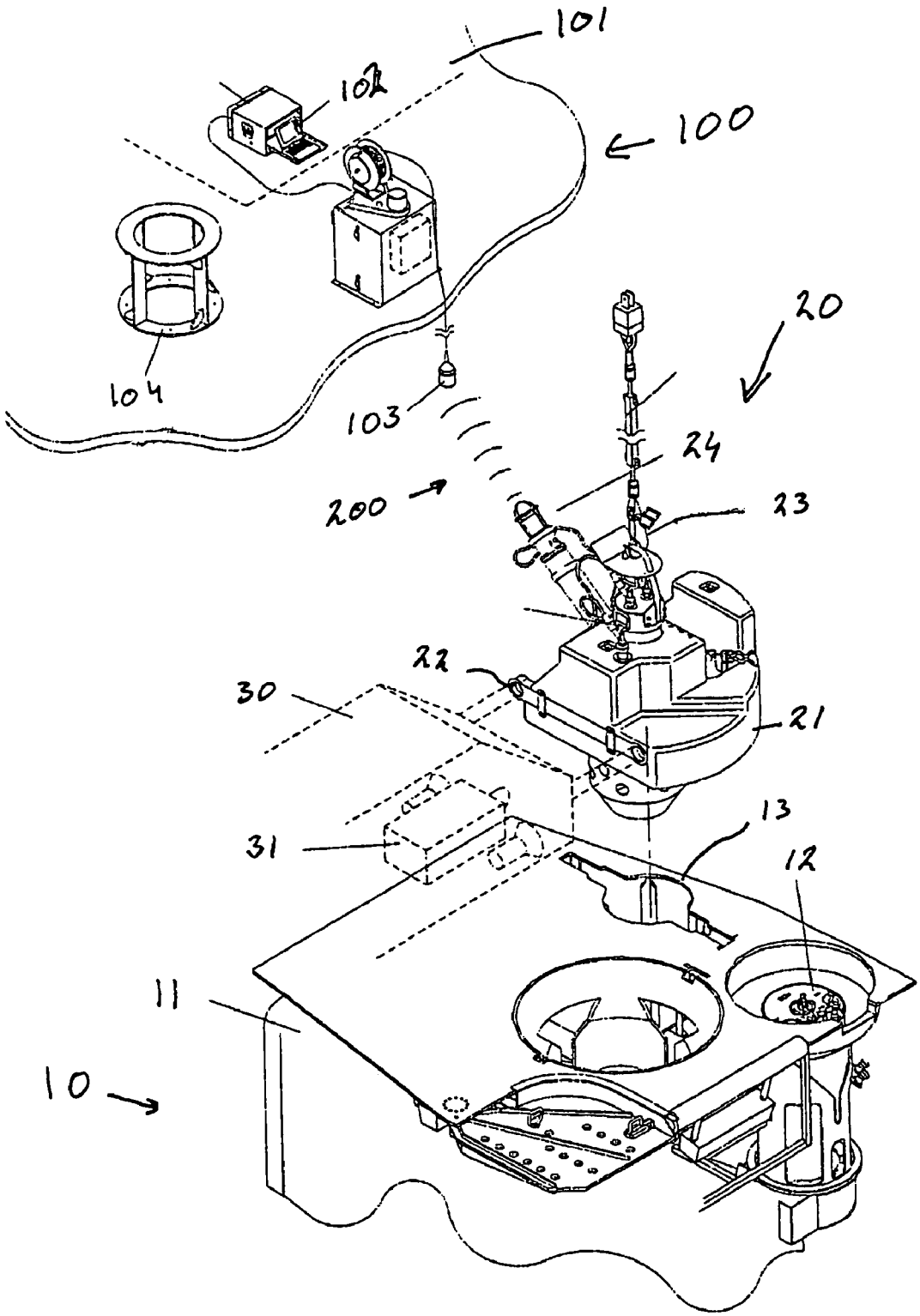
101
102
100
20
104
103
24
200
23
22
30
21
13
31
12
11
10

MONITORING OF A RESERVOIR

BACKGROUND OF THE INVENTION

The invention relates to a system for monitoring a subsea oil or gas reservoir by means of measuring instruments located in a completed well.

In exploring for oil or gas, particularly at great depths, it is desirable to know as much as possible about the hydrocarbon-bearing formation. In the initial phase of exploring for oil and gas this is done by means of seismic surveys, which provide an "image" of the formation. By analysing these images, geologists can then see whether there are oil and/or gas-bearing formations under the ground. However, it will not be possible to obtain a certain indication until wells have been drilled down to the reservoir.

During drilling further information can be obtained about the formation (MWD=Measurement While Drilling). Measurements are carried out, for example, of pressure, temperature, resistivity and gamma waves. Another method normally employed for obtaining information about the reservoir is to take core samples of the rock at regular intervals. If oil is discovered, samples thereof will also be taken. These samples provide valuable information concerning the nature of the reservoir, its pore size (which indicates the utilisation factor), its permeability, how the oil is distributed in the reservoir, etc., all in order to obtain information about the quality of the oil and to some extent also the size (extent) of the reservoir together with the prospects for utilisation.

SUMMARY OF THE INVENTION

The deployment of seismic meters on the seabed has also previously been proposed for receiving signals transmitted during drilling, thus enabling data to be obtained concerning the geology.

After an oil or gas well has been drilled, it is completed. A completed hole comprises a casing that circumscribes the hole in which the production tubing is to be installed. A production tubing is then installed in the well. The tubing normally includes sensors and electromechanical devices mounted downhole in order to control the production well. The sensors monitor downhole parameters such as pressure, temperature and flow rates, and there may also be sensors for detection of water, gas volume and sand. The communication up and down through the hole with the sensors and the electromechanical devices is normally implemented via a cable, but may also be carried out by means of acoustic signals or electrical pulses.

Produced oil or gas flows up through the production tubing and over into a flowline leading to a surface installation, such as a floating production vessel or a land-based station. A so-called umbilical also has to be connected to the well. This contains pipelines for hydraulic fluid for operation of the valves in the Christmas tree, electric wires for power supply together with wires (electrical or fibre optic) for signal transmission from the measuring instruments in the well and on the Christmas tree.

In the case of a field development with a great many wells, a well that is prepared for production is usually abandoned while additional wells are drilled. One of the main reasons for this is the risk of damage to flowlines and umbilicals that may occur due to other activity in the vicinity, particularly drilling of adjacent wells. The wells are therefore ready for production but are not coupled up. Only when a cluster of wells are ready are the individual wells linked up to the joint production unit.

The instruments installed in the well are active, but since they are not connected to means for signal transmission, no information can be obtained from these instruments before the field is coupled up as mentioned above.

Every operation carried out in the formation (drilling etc.) causes changes in the reservoir. In addition to this, tests will be conducted such as formation testing or fractionation, which also cause changes in the reservoir. During such tests, logging and other measurements are also carried out in the well on which work is being performed. It has been desirable to also obtain information from other adjacent wells (adjoining wells) in the area during such tests, but to date such information has not been considered to be sufficiently valuable to justify the cost and trouble of allocating a separate vessel for connecting to these completed wells.

It has therefore been an object of the present invention to arrive at a simple and inexpensive method for obtaining information from a completed well. According to the invention it is proposed that a recoverable monitoring unit should be installed on or in connection with the Christmas tree's control module. The monitoring unit comprises a storage unit, which enables data retrieved from the downhole measuring instruments to be stored in real time. By this way information can be acquired about the reservoir without having to use expensive intervention equipment.

The unit comprises an acoustic transmitter for transmitting data to a station on the surface. This may, for example, be a ship, which is positioned above the well at regular intervals in order to retrieve data. It may also be a stationary buoy, which is positioned above the well and comprises means for transmitting signals (radio or telephony) to a land station.

During drilling of a well, various data will normally be continuously retrieved such as recorded pressure and temperature changes, which provide valuable information. Simultaneously in the adjoining well, data or changes in the well that occur as a result of drilling the well will be recorded. When these data are compared with measured data for the bore well, geologists will be able to obtain more information about the formation and the hydrocarbon deposit.

When the drilling of wells is completed, pressure testing and production testing of the well are also usually conducted. One example of such tests is pressure testing in the well during drilling where a pressure increase in the second well and how long it takes, etc. may be recorded. By injecting water into well 2 it can be recorded when the water reaches well 1, which in turn tells something about the formation's permeability.

During well testing, real time transmission of data will be relevant, for example by means of a buoy as described above. The data can then be transmitted to the control room in the drilling rig that is conducting the testing. Continuous information will thereby be obtained about the result of the testing of the well. It will also permit the test conditions to be varied in order to obtain more information. An example of this is where during the pressure testing the pressure build-up in the well may be varied. The result of this can be read on the measuring instruments in the completed well and by looking at the time difference between pressure build-up and reading the pressure in the monitoring well, important information can be obtained about the reservoir's permeability. In the same way water may be injected into the bore well and a reading may be taken of when the water reaches the second well. This will also provide information about the formation's permeability.

Another type of well operation that will be interesting to monitor is formation treatment such as chemical or mechanical fractionation. In the case of mechanical fractionation, i.e. injecting particles under pressure that open the pores in the well, a pressure build-up will occur in the first well that can be recorded by the instruments. The form of the pressure build-up, i.e. the time difference between injecting and reading the pressure increase, how quickly the pressure build-up occurs, etc. provides information about the reservoir. In the case of chemical fractionation, it will also be possible to sense a pressure build-up. However, by means of instruments that can sense when the chemical fluids have penetrated the first well, it will also be possible to find out more about the formation's permeability. For this purpose, instruments can be employed for measuring radioactivity and a radioactive substance can be added to the chemical injection fluid.

Thus the invention relates to a method for monitoring a well from an adjacent well, which comprises placing a monitoring unit on the adjacent well, receiving information from measuring instruments and transmitting the said measured data to the surface.

The monitoring unit advantageously comprises a storage unit, thus enabling the information acquired to be stored until a suitable opportunity for transmitting data.

The invention will now be described in greater detail by an embodiment with reference to the attached single figure, which is a general drawing of the monitoring system.

DETAILED DESCRIPTION OF THE PREFERRED EMBODIMENTS

As illustrated in the drawing, the present invention is shown in conjunction with a well, which is generally indicated by 10, that is located on the seabed. The well extends downwardly into the seabed to a hydrocarbon-bearing formation and is completed in the normal manner. The well comprises a wellhead Christmas tree 11 which is equipped with valves (not shown) for control of the production and additional devices which are commonly known to a person skilled in the art. A control module 12 is mounted on the Christmas tree 11 and includes pilot valves for controlling hydraulic fluid to the valves in the Christmas tree, valves for injection of chemical treatment fluids, and control and monitoring systems for the well. In addition, a number of sensors (not shown) which are connected to the control module 12 are mounted in the well. The Christmas tree further includes a receiving device 13 which includes suitable mechanical and electrical connectors, the purposes of which will be described hereafter.

In accordance with the present invention, a monitoring unit 20 is mounted on the Christmas tree 11. The monitoring unit is preferably releasably mounted on the Christmas tree 11 so that it can be recovered and used on other wells. Deployment and recovery of the monitoring unit 20 may advantageously be accomplished by means of an underwater remotely operated vehicle (ROV) 30, which is equipped with manipulators to enable it to grip the monitoring unit and possibly also a camera 31 for monitoring the operation.

The monitoring unit 20 comprises a housing 21 in which a number of electronic components, such as a control circuit, data storage units and receiving units for electronic signals, are located. The housing has a connecting device on its lower end which is adapted to be received in the receiving device 13, thus enabling the monitoring unit 20 to be mounted on the Christmas tree. The connecting device may be a commonly known type comprising a connection for electrical signals. The monitoring unit 20 further comprises means 22 to enable it to be manipulated by the ROV, and possibly also a lifting hook 23. The monitoring unit 20 preferably also includes a transponder 24 for transmitting acoustic signals to the surface.

On the surface, for example located on a vessel, is a control and receiving section 100 for receiving signals transmitted from the well. The section 100 comprises a control room 101 in which are provided means for receiving signals from the monitoring unit 20. A computer 102 is provided with a storage unit for data. The computer is connected to a transducer 103, which receives the acoustic signals from the seabed. The transducer is advantageously mounted at the end of a cable that can be lowered into the water from the vessel in order to achieve better receiving conditions.

The vessel is also advantageously arranged to lower and recover the monitoring unit 20, for which purposes the vessel includes equipment for controlling an ROV for underwater operations. As illustrated in the drawing, the vessel preferably also includes a parking device 104 for the monitoring unit 20.

When a well has been drilled and completed, it is abandoned by the drilling rig so that it can drill the next well. While the rig is drilling the next well, a second vessel carrying a monitoring unit is positioned above the completed well. The monitoring unit is lowered into the water and connected to the Christmas tree. A connection is hereby also established between the monitoring unit and the control module. Signals from downhole instruments transmit data to the control module, which sends the data on to the monitoring unit. The control unit in the monitoring unit receives these signals.

If the vessel is still located above the well, the monitoring unit can transmit the data in real time to the control station in the vessel. However, the vessel will normally now have left the location in order to perform other tasks. In this case the monitoring unit will store the received data in its storage unit. When the vessel is again moved over the well, a message is transmitted down to the monitoring unit and the electronic control circuit therein will now transmit the signals to the acoustic transponder for transmission to the control station on the surface.

The data can be transmitted by radio or telephone from the vessel to a land station or they can be stored in the vessel and brought ashore.

If real time monitoring is required, for example in connection with pressure testing of the drilled well, where it may be desirable to monitor the changes in the reservoir, the receiving equipment may be mounted on the adjacent rig from which testing is being conducted. Another possibility is to deploy a buoy with receiving equipment for the acoustic signals from the monitoring unit. The buoy is equipped with transmitting equipment, for example wireless transmission to a land station or to the said drilling rig.

In the preferred embodiment the signals are acoustic signals that are transmitted from a transponder on the monitoring unit. However, it is within the scope of the person skilled in the art that other types of signals may be employed that are suitable for transmitting information.

The invention claimed is:

1. A method for monitoring a subsea hydrocarbon-bearing formation by means of instruments located in a first hydrocarbon well, the method comprising the steps of:

drilling and completing the first well, including placing instruments in the well;

installing a Christmas tree on the first well;

attaching a control module to the Christmas tree;

establishing communication between the control module and the instruments;

positioning a monitoring unit adjacent the first well;

establishing communication between the monitoring unit and the control module;

conducting operations in a second well;

receiving signals from the instruments in the first well in response to the operations in the second well; and transmitting the signals via the monitoring unit to a receiver station.

2. The method of claim 1, wherein the operations in the second well comprise drilling.

3. The method in of claim 1, wherein the operations in the second well comprise reservoir testing.

4. The method of claim 1, wherein the signals are transmitted in real time.

5. The method of claim 4, wherein the signals are transmitted to a buoy which is positioned above the first well, and the said buoy transmits the signals on to a land station.

6. The method of claim 1, wherein the signals are stored in the monitoring unit.

7. The method of claim 6, wherein the signals are transmitted to a vessel which is temporarily positioned above the first well.

8. In combination with a Christmas tree which is mounted on a well and a control module which is mounted on the Christmas tree and which receives signals from measuring instruments in the well, the improvement comprising a device for monitoring a subsea reservoir which includes:

a monitoring unit which is releasably attached to the Christmas tree and is operatively connected to the control module to receive signals therefrom which are generated by the downhole instruments;

wherein the monitoring unit comprises an acoustic transponder for transmitting the signals from the control module to a remote location by means of acoustic signals.

9. The device of claim 8, wherein the monitoring unit comprises a storage unit.

10. The device of claim 8, wherein the monitoring unit comprises a connecting device for connecting to the Christmas tree.

11. The device of claim 8, wherein the monitoring unit is recoverable.

12. The device of claim 8, wherein the remote location is a buoy which comprises means for transmitting the data to a land station or a drilling rig.

13. The device of claim 8, wherein the remote location is a vessel which comprises means for storing the transmitted data.

* * * * *